United States Patent [19]

Yamamoto et al.

[11] Patent Number: 4,843,811

[45] Date of Patent: Jul. 4, 1989

[54] BOBBIN TRANSPORTING SYSTEM

[75] Inventors: Yoshio Yamamoto, Kyoto; Syuichi Kikuchi, Shiga; Kazuo Nakanishi, Uji; Yoshihiko Kawasaki, Kyoto, all of Japan

[73] Assignee: Murata Kikai Kabushiki Kaisha, Kyoto, Japan

[21] Appl. No.: 108,211

[22] Filed: Oct. 13, 1987

[30] Foreign Application Priority Data

Oct. 14, 1986 [JP] Japan ..... 61-245047

[51] Int. Cl.[4] ..... D01H 9/18; B65H 67/06

[52] U.S. Cl. ..... 57/281; 57/1 R; 57/276; 198/346.1; 198/346.2; 198/577; 209/552; 209/927; 242/35.5 R; 242/35.5 A

[58] Field of Search ..... 57/1 R, 276, 266, 267, 57/281, 90; 242/35.5 R, 35.5 A; 209/539, 552, 927; 198/434, 436, 620–622, 25 C, 577, 346.2, 346.1

[56] References Cited

U.S. PATENT DOCUMENTS

| | | | |
|---|---|---|---|
| 3,195,298 | 7/1965 | Furst | 57/281 X |
| 3,828,682 | 8/1974 | Klein | 57/281 X |
| 4,041,686 | 8/1977 | Inaba et al. | 242/35.5 A X |
| 4,181,228 | 1/1980 | Hashimoto et al. | 209/927 X |
| 4,432,198 | 2/1984 | D'Agnolo | 57/276 |
| 4,660,369 | 4/1987 | Konishi et al. | 57/281 |
| 4,703,618 | 11/1987 | Dinkelmann | 242/35.5 A X |
| 4,736,581 | 4/1988 | Uchida | 57/281 |

FOREIGN PATENT DOCUMENTS 61-32231 7/1986 Japan .

*Primary Examiner*—John Petrakes

*Attorney, Agent, or Firm*—Spensley Horn Jubas & Lubitz

[57] ABSTRACT

A bobbin transporting system includes a spinning bobbin transporting path and an empty bobbin transporting path both provided between a spinning frame and a winder, and a spinning bobbin reservoir path is formed intermittently of the spinning bobbin transporting path between the spinning frame and winder for temporarily reserving thereon all of spinning bobbins on a transport band which have been doffed by the spinning frame.

12 Claims, 6 Drawing Sheets

BOBBIN TRANSPORTING SYSTEM

FIELD OF THE INVENTION

This invention relates to a bobbin transporting system between a spinning frame and an automatic winder.

RELATED ART STATEMENT

Most spinning frames are ring spinning frames, such as, for example, the ring spinning frame illustrated in FIGS. 9 and 12. In particular, the ring spinning frame shown includes an automatic doffing apparatus 1, a transport apparatus 2 including a transport band which can be circulated forwardly and reversely along spindles, and an empty bobbin supply apparatus 3. Thus, spinning bobbins wound up on spinning spindles 4 are then pulled off from the spindles 4 by the simultaneous doffing apparatus 1, which is known itself, and are mounted onto bobbin supporting pegs 5 on the transport band 2 while empty bobbins on the transport band 2 are mounted onto the spindles 4 so as to prepare for subsequent doffing operation.

As the transport band 2 is circulated in a direction of an arrow mark 7, the doffed spinning bobbins 6 are moved up along an inclined section 2*a* adjacent a right-hand end of the transport band 2 and then dropped from the end portion of the transport band 2 into a box 8. After all the spinning bobbins on the transport band have been ejected, the band 2 is circulated intermittently in a direction of another arrow mark 9 while empty bobbins within the empty bobbin box 3 are supplied one after another to the pegs of the band.

When it is intended to connect such an existing spinning machine to an automatic winder of a next step so as to construct a so-called spinning winder, if, for example, it is designed so as to drop and supply spinning bobbins one by one from the right-hand end portion 2*a* of the band each time a spinning bobbin requesting instruction is developed from the winder, it is impossible to supply empty bobbins to the band until after completion of ejecting of all of the spinning bobbins. Accordingly, in this case, even if ejecting of the spinning bobbins is completed, a subsequent doffing operation cannot be entered immediately thereof, and the spinning machine must necessarily be stopped causing deterioration of the working efficiency.

One of solutions to such a problem as described above is shown in FIG. 11 wherein an empty bobbin supply apparatus 3 is located at a station Z adjacent an end of a transport band 2, remote from a spinning bobbin ejecting station X. The transport band 2 is circulated intermittently only in one direction 7 such that a spinning bobbin may be ejected at a right-hand end portion 2*a* of the band while at the same time an empty bobbin is supplied to an empty peg 5*b* at a left-hand end portion 2*b* of the band. It is to be noted that while it is necessary in this instance that bobbin mounting pegs be located over an entire periphery of the transport band, empty bobbins are arranged along spinning spindles simultaneously with completion of ejecting of empty bobbins, and accordingly a subsequent doffing operation can be entered immediately after completion of such ejecting of spinning bobbins.

However, in this instance, the empty bobbin supply apparatus 3 of the existing spinning frame must be moved to a location opposite to the spinning bobbin ejecting station of the transport band, and accordingly there are problems such as a problem that reconstruction is required to increase the distance between a power box or a control box 10 and a leftmost spinning spindle 4Z.

OBJECT AND SUMMARY OF THE INVENTION

It is an object of the present invention to provide a bobbin transporting system which can interconnect, when an existing spinning frame and an automatic winder are to be interconnected so as to construct a spinning winder, the existing spinning frame and the automatic winder without reconstructing the spinning frame and without deteriorating the working efficiency of the spinning frame and the winder.

A bobbin transporting system between a spinning frame and an automatic winder includes a transport band which can be circulated in forward and reverse directions along spinning spindles and an empty bobbin supply apparatus which is located on a spinning bobbin ejecting side above the transport band and which is constructed such that it comprises a spinning bobbin transporting path and an empty bobbin transporting path both provided between the spinning frame and the winder, and a spinning bobbin reservoir path formed intermediately of the spinning bobbin transporting path between the spinning frame and the winder for temporarily reserving thereon all of spinning bobbins on the transport band which have been doffed by the spinning frame.

All of spinning bobbins on the transport band which have been doffed on the spinning frame are delivered at once onto the spinning bobbin transporting path, independently of operation of the winder, and are reserved once on the reservoir path formed on the spinning bobbin transporting path so as to make a condition in which no spinning bobbin exists on the transport band. Then, each time a request for a spinning bobbin is made as an empty bobby is ejected from the winder, a spinning bobbin is supplied from the reservoir path. Meanwhile, an empty bobbin to be returned to the spinning frame is supplied onto one of pegs on the transport band which is already in a stand-by condition. Thus, at a point of time when the spinning bobbins on the reservoir path are all supplied to the winder, empty bobbins are already arranged along the spinning spindles. Accordingly, without requiring additional time for supply of empty bobbins, similar effects can be anticipated to those of the reconstructed spinning winder described hereinabove, that is, a spinning winder which is reconstructed such that a spinning bobbin may be delivered from one end of a transport band while at the same time an empty bobbin is supplied from the other end of the transport band.

DETAILED DESCRIPTION OF THE INVENTION

Now, an embodiment of the present invention will be described with reference to the drawings.

Figure 1:
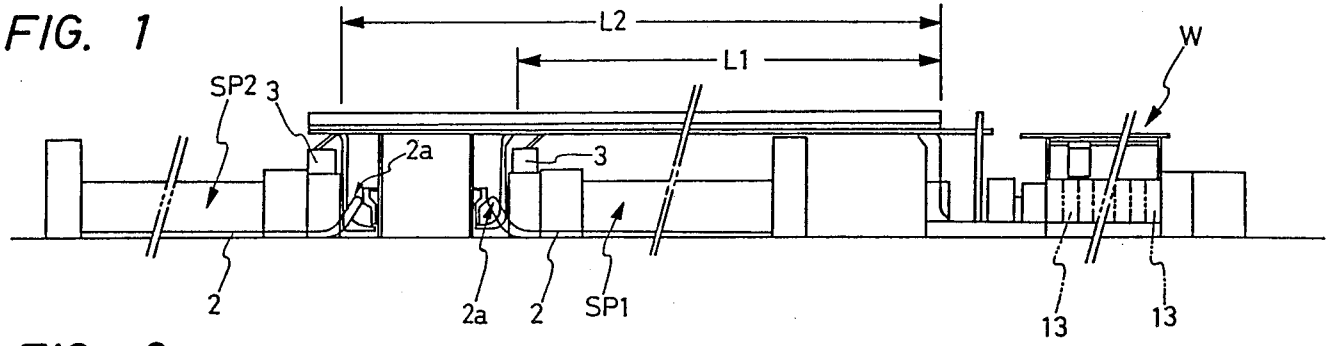
FIG. 1 is a front elevational view of general construction showing an embodiment of the system of the present invention, FIG. 2 a plan view of the system of FIG. 1, FIG. 3 a plan view showing a connecting section between a spinning bobbin transporting path and a winder.
Figure 2:
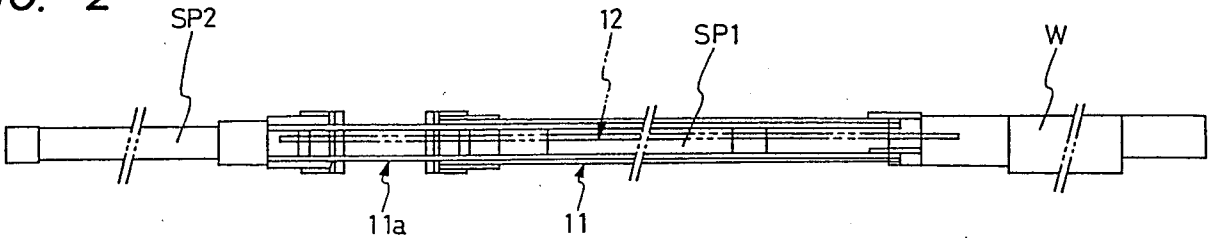

Referring to FIGS. 1 and 2, an example of spinning winder is shown wherein two spinning frames SP1, SP2 and one automatic winder W are interconnected by a spinning bobbin reservoir path 11 and an empty bobbin transporting path 12. In each of the spinning frames SP1, SP2, a transport band 2 is installed for back and forth circulation along a row of spindles. In the spinning frame SP1, spinning bobbins are ejected from an inclined end portion 2*a* on the left-hand side of the drawing while empty bobbins are supplied onto pegs of the transport band from an empty bobbin supply apparatus 3 on the same side, and in the other spinning frame SP2, spinning bobbins are ejected from an inclined end portion 2*a* of the transport band 2 on the right-hand side while empty bobbins are supplied onto pegs of the transport band from an empty bobbin supply apparatus 3 on the same side.

A space is formed between the ends of the spinning frames SP1, SP2, that is, between the inclined end portions 2*a* of the spinning frames SP1, SP2. The spinning bobbins which have been wound in each spinning frame are ejected at the near portion to the space and the empty bobbin supply apparatus 3 may be located near to the space. The space may be used for a passage for a worker, for example, to conveniently watch or inspect the operation of the spinning system.

Meanwhile, the automatic winder W located rightwardly of the spinning frame SP1 is constituted from a plurality of winding units 13 arranged in a juxtaposed relationship. Supply of spinning bobbins to the individual winding units and transportation of empty bobbins discharged from the winding units may be effected by various means.

Figure 7:
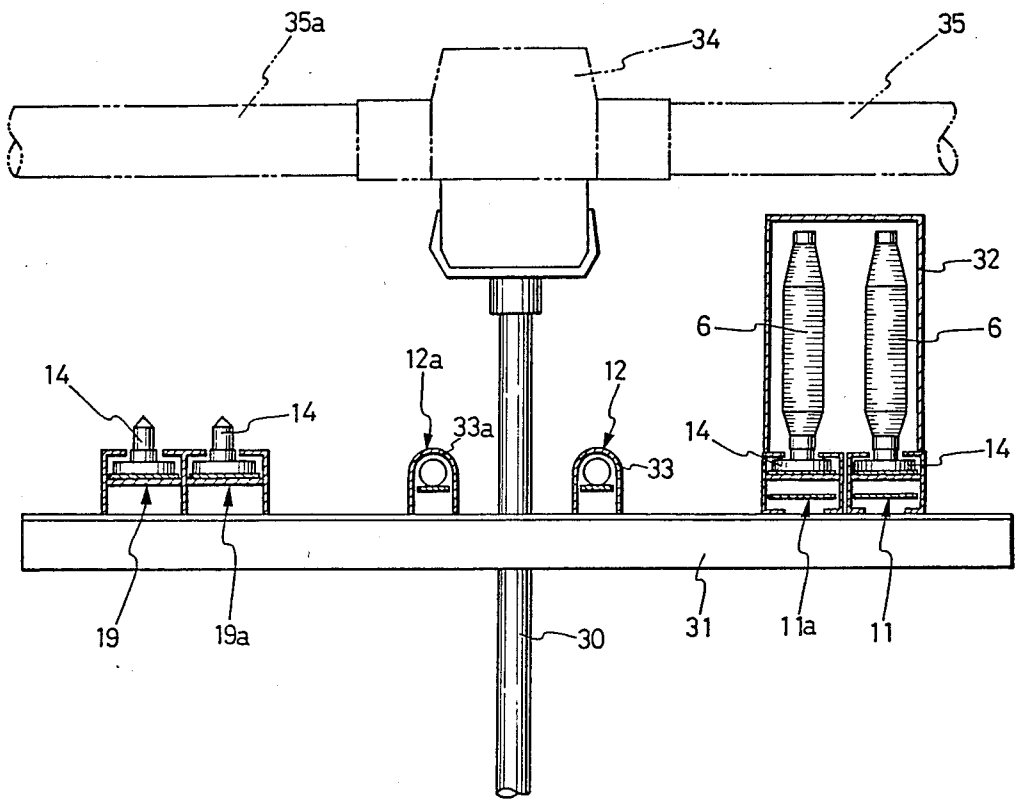
Figure 9:
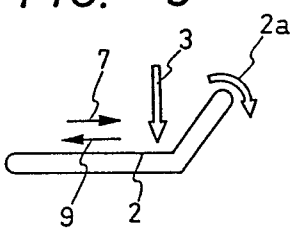

In the present embodiment, a winder disclosed in Japanese patent publication No. 61-32231 which was applied for patent precedingly by the present applicant is applied as the automatic winder W. In particular, the winder is constituted such that spinning bobbins are fitted and supported uprightly on and fed by such trays as shown in FIG. 7. The spinning bobbins are transported independently of each other, and then taken into and rewound by the winding units together with the trays, whereafter empty bobbins are ejected from the winding units while they remain integral with the trays.

Figure 3:
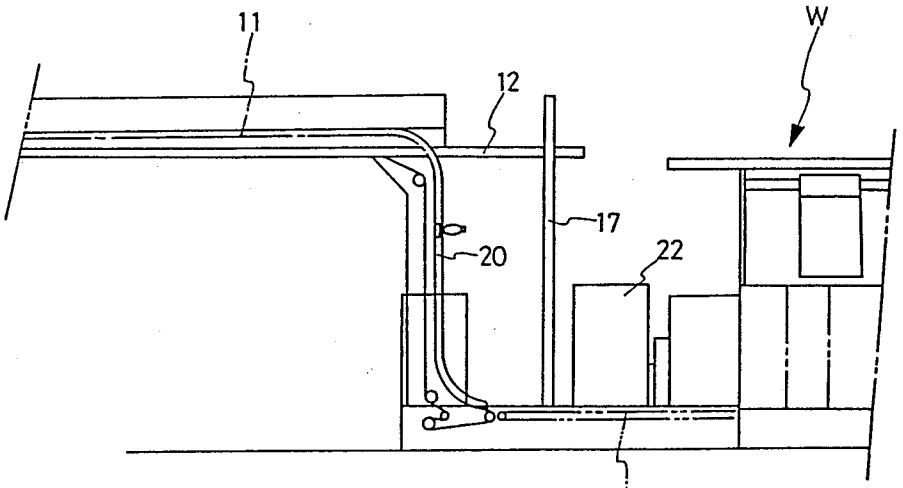
Figure 4:
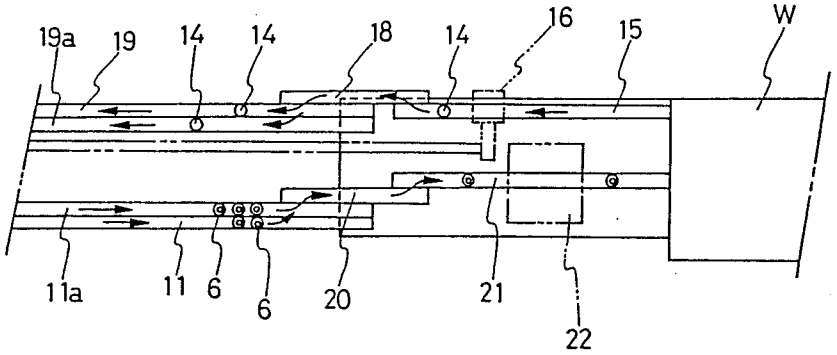
FIG. 4 is a plan view of the connecting section of FIG. 3, FIG. 5 a plan view showing a connecting section between the spinning bobbin transporting path and a spinning frame, FIG. 6 a plan view of the connecting section of FIG. 5, FIG. 7 a sectional view taken along line VII—VII of FIG. 5, FIG. 8 a time chart of an embodiment of the present invention, FIG. 9 a schematic illustration of a prior art spinning frame, FIG. 10 a time chart of a reconstructed spinning winder, FIG. 11 a schematic illustration of the reconstructed spinning frame, and FIG. 12 a plan view showing an example of a prior art spinning frame.

Referring to FIGS. 3 and 4, the empty bobbins integral with trays ejected from the winder W are transported in a direction indicated by arrow marks on a return path 15. The empty bobbins are pulled off from the trays at an empty bobbin pulling off station 16 by a known pulling off device. Then, the empty bobbins are transferred from a lifting path 17 onto the empty bobbin transporting conveyor 12 above by a conveyor and are then transported thereby to the empty bobbin supply stations of the spinning frames.

Meanwhile, the empty trays 14 from which the empty bobbins have been pulled off at the empty bobbin pulling off station 16 are then transferred onto an empty tray transporting path 19 above via a lifting conveyor 18 which is contiguous to the return path 15. The empty trays are thus transported to spinning bobbin supplying positions at one end portions of the spinning frames of FIG. 1. It is to be noted that while ejecting of spinning bobbins at the ends of the spinning frames is stopped, empty bobbins are temporarily reserved on the transporting path 19 so as to wait for subsequent supply thereof.

It is to be noted that, referring to FIG. 4, the empty tray transporting conveyor 19 is provided for the spinning frame SP1 of FIG. 1 and another conveyor 19*a* is provided for the spinning frame SP2. In this embodiment, the whole path 11 is utilized for the reservoir path 11.

On the other hand, the spinning bobbins 6 integral with the trays reserved on the spinning bobbin reservoir paths 11, 11*a* of FIGS. 3 and 4 are delivered one by one in response to a spinning bobbin requesting signal from the winder W. The spinning bobbins are fed together with the trays onto a spinning bobbin supply path 21 on the winder side via the reservoir path 11 and a falling conveyor 20 and then to a yarn end finding device 22 at which they are prepared for subsequent winding, whereafter the spinning bobbins are supplied to the individual winding units of the winder.

Figure 5:
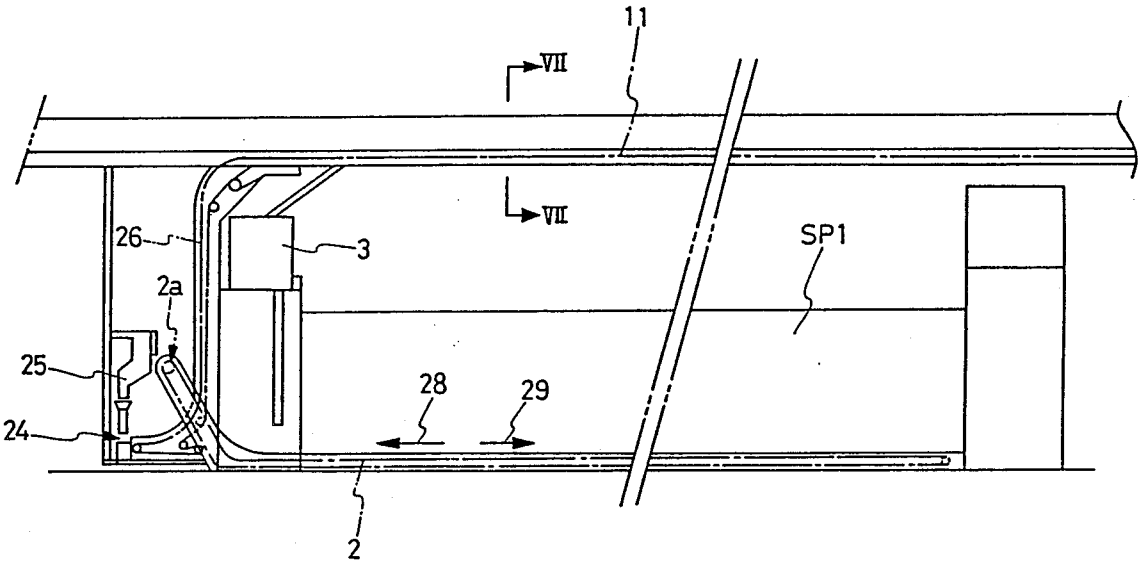
Figure 6:
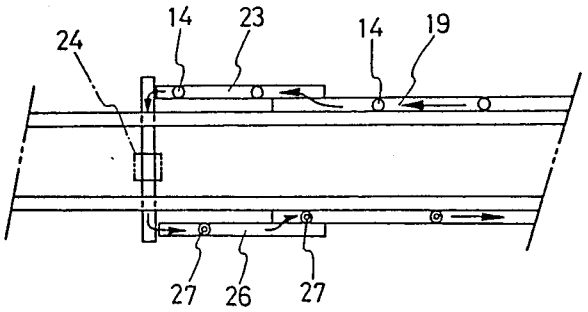

Meanwhile, referring to FIGS. 5 and 6, a spinning bobbin supply apparatus located adjacent one end of each of the spinning frames and transporting paths around the spinning bobbin supply apparatus are shown. In particular, empty trays 14 which are fed on the empty tray transporting path 19 above are fed to a spinning bobbin supply station 24 via a tray falling conveyor 23, while spinning bobbins discharged from the inclined end portion 2*a* of the transport band 2 of FIG. 5 are thrown into a chute 25 so that they are supplied and fitted one after another onto an empty tray which is in a stand-by condition below the chute 25. The trays 27 on which the spinning bobbins are fitted are integrally transferred from a lifting conveyor 26 onto the spinning bobbin transporting path 11 above, that is, the reservoir path, so that they may be temporarily reserved on the reservoir path.

It is to be noted that, referring to FIG. 5, when the transport band 2 is circulated in a direction of an arrow mark 28, spinning bobbins on the band are ejected into the chute 25. When the transport band 2 is circulated intermittently in the opposite direction 29 after all the spinning bobbins have been ejected, empty bobbins are supplied onto the pegs of the transport band from the empty bobbin supply apparatus 3.

It is to be noted that, referring to FIG. 1, the length L1 of the reservoir path 11 for storing spinning bobbins ejected from the spinning frame SP1 is, in the present embodiment, a length sufficient for the reservoir path 11 to reserve therein all of spinning bobbins doffed at a time by the spinning frame SP1. The length L2 of the reservoir path 11a for storing empty bobbins on the spinning frame SP2 side is a length sufficient for the reservoir path 11*a* to reserve therein all of spinning bobbins doffed at a time by the spinning frame SP2.

FIG. 7 shows a cross section taken along line VII—VII of FIG. 5, and a beam 31 is secured making use of a support post 30 which is located above each of the spinning frames for supporting sliver bobbins thereon while the empty tray transporting conveyors 19, 19*a*, the reservoir paths 11, 11*a* for spinning bobbins, and the empty bobbin transporting paths 12, 12*a* are constituted from conveyors, guides, and so on. Reference numeral 32 denotes a cover for preventing fly waste, dust and the like from sticking to yarn layers of spinning bobbins while being reserved or transported, and the cover 32 extends over the entire areas L1, L2. Reference symbols 33, 33*a* denote covers provided for the empty bobbin transporting paths. Reference numeral 34 denotes a cleaning device which travels along a spinning frame platform and is a known device wherein part of air ducts 35, 35*a* jets or sucks air toward or from the spinning frame in order to prevent sticking of fly waste.

Now, operation of the bobbin transporting system having such a construction as described above will be described.

Figure 8:
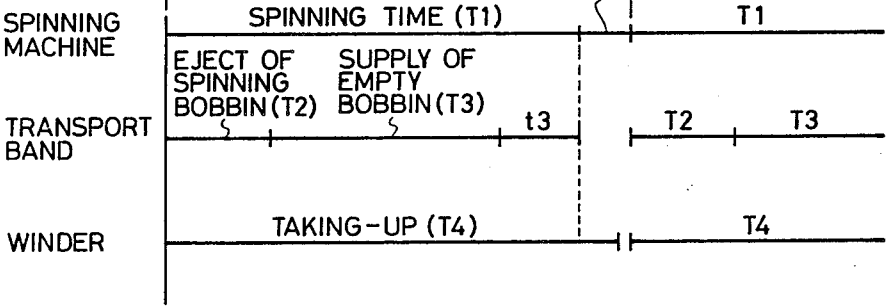

Spinning bobbins doffed at a time by the spinning frame SP1 and fitted on the transport band are ejected and supplied onto empty trays as the transport band is circuited in the direction indicated by the arrow mark 28 of FIG. 5. In this instance, surplus trays are arranged in the transporting system in advance so that a large number of empty trays may already be in a stand-by condition on the empty tray transporting path 19. All the spinning bobbins on the transport band are ejected within a time T2 shown in FIG. 8 and thus reserved on the spinning bobbin reservoir path 11 above the spinning frame.

It is to be noted that when one cycle of a spinning time T1 plus a doffing time t1 is completed and discharging of spinning bobbins doffed is started, winding is simultaneously started at the winder. In particular, when a bobbin requesting signal is developed, spinning bobbins on the reservoir path are delivered and supplied one by one to the winder. In this instance, however, the interval of time after which a spinning bobbin is ejected from the transport band is smaller than the interval of time after which a spinning bobbin is delivered from the reservoir path. Accordingly, spinning bobbin are accumulated one after another on the reservoir path, and all of the doffed spinning bobbins are ejected from the transport band within the time T2. For example, if it is assumed that one cycle of a spinning time plus a doffing time is 2 to 4 hours (which varies depending upon the count of the yarn), then the time T2 is 15 minutes.

After ejecting of the spinning bobbins has been completed, supply of empty bobbins to the transport band can be started and will be completed within a time T3. The time T3 is normally 30 to 40 minutes, but this must only elapse within the spinning time T1, and time control is thus effected with spare time t3.

Meanwhile, at the winder, winding is started simultaneously with ejecting of spinning bobbins, and the number of winding units and the speed of yarns are selected so that winding of all the spinning bobbins may be completed within a time T4. It is to be noted that, in the case of the present embodiment, winding can be continued even if doffing is started after the spinning time T1 has elapsed. In other words, while a spinning bobbin or bobbins exist within the reservoir path 11, winding is possible, and only an expression $T4<T1+t1$ must stand.

Figure 11:
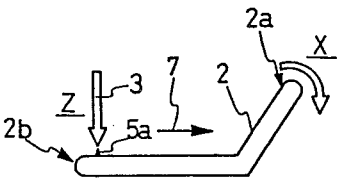
Figure 10:
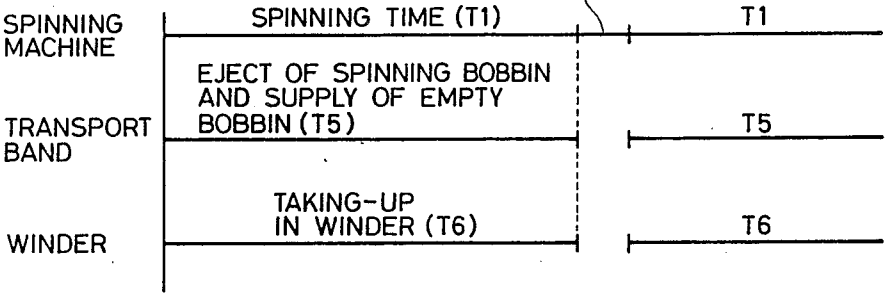

FIG. 10 shows a time chart where a spinning bobbin ejecting station 2*a* and an empty bobbin supply station 3 are located at opposite locations in such a reconstructed spinning frame as shown in FIG. 11. In this case, spinning bobbins doffed onto a transport band are delivered one by one in response to a request for a spinning bobbin from a winder side, while bobbins are supplied onto the transport band at the opposite location. Accordingly, ejecting of spinning bobbins and supply of empty bobbins as well as winding of the winder are completed substantially at the same time within a spinning time T1. In other words, ejecting of spinning bobbins is impossible within a doffing time t1, and accordingly winding of the winder is stopped during doffing operation.

Figure 12:
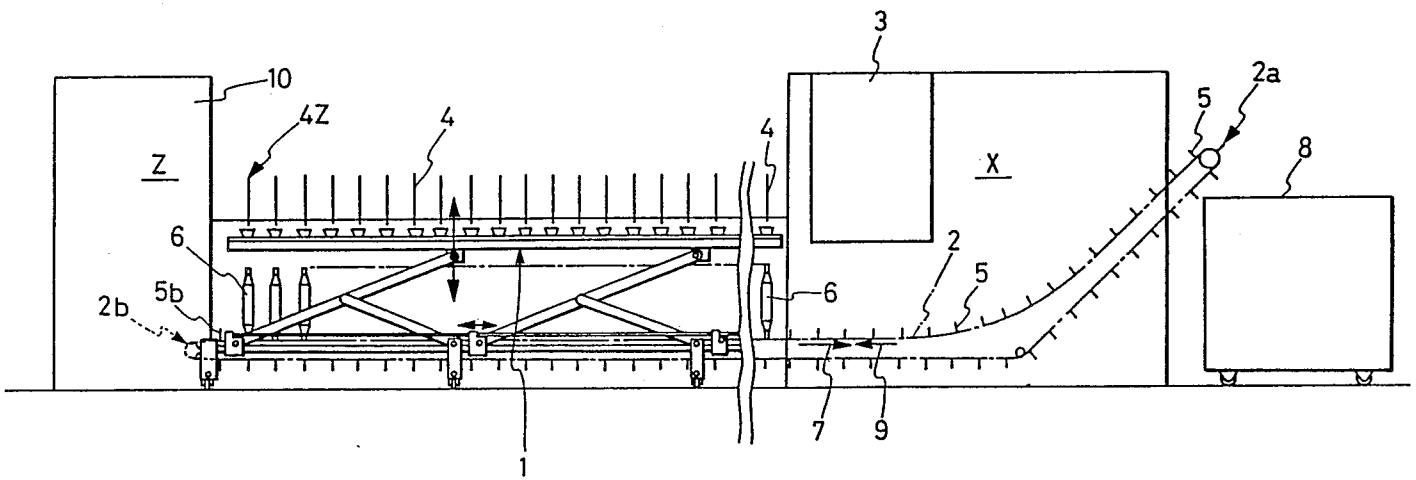

In this manner, such a prior art spinning frame and an automatic winder as shown in FIG. 12 can be interconnected so as to construct a spinning winder without reconstructing the existing spinning frame.

It is to be noted that while in the embodiment an example is shown wherein the present invention is applied to a system in which bobbins are transported individually in an uprightly erected condition using trays and empty trays which are transported to a spinning frame side while spinning bobbins discharged from a transport band are reserved on a reservoir path while left fitted on trays, it is alternatively possible to construct the bobbin transporting system such that trays are circulated within an area of a winder and spinning bobbins are placed directly onto a conveyor of the reservoir path 11 so as to reserve the spinning bobbins on the reservoir path until the spinning bobbins are ejected from the reservoir path and fitted onto the trays.

Further, it is also possible to apply the present invention to a transporting system which does not utilize trays, for example, to a transporting system wherein a winder includes a plurality of winding units each having a magazine for storing several spinning bobbins therein and bobbins are automatically supplied into the magazines by means of a bobbin transporting conveyor which travels along the magazines.

As apparent from the foregoing description, according to the present invention, an existing spinning frame and an automatic winder can be interconnected by a bobbin transporting path of a closed loop without reconstructing the existing spinning frame in order to construct a spinning winder. Besides, the existing spinning frame and the winder can be interconnected without deteriorating the working efficiency of the spinning frame and the winder.

What is claimed is:

1. A bobbin transporting system between a spinning frame operable for doffing spinning bobbins and an automatic winder, said bobbin transporting system including a transport band which can be circulated in forward and reverse directions along spinning spindles the transport band being operable for receiving spinning bobbins doffed from the spinning frame and having a spinning bobbin ejecting side, said bobbin transporting system further including an empty bobbin supply apparatus located adjacent the spinning bobbin ejecting side above said transport band, characterized in that the bobbin transporting system comprises a spinning bobbin transporting path for receiving spinning bobbins ejected from said transport band and an empty bobbin transporting path both provided between said spinning frame and said winder, and a spinning bobbin reservoir path formed within said spinning bobbin transporting path for temporarily reserving thereon substantially all of spinning bobbins on said transport band which have been doffed by said spinning frame.

2. A bobbin transporting system as claimed in claim 1, wherein said spinning bobbin transporting path is used as the spinning bobbin reservoir path.

3. A bobbin transporting system as claimed in claim 1, wherein the length of each reservoir path for storing spinning bobbins is a length sufficient for reserving therein all of spinning bobbins doffed at a time by a spinning frame.

4. A bobbin transporting system as claimed in claim 1, wherein said spinning bobbin reservoir path is provided above the spinning frame to extend in a longitudinal direction of the spinning frame.

5. A bobbin transporting system as claimed in claim 1, wherein both of said spinning bobbin reservoir path and said empty bobbin transporting path are provided above the spinning frame to extend in a longitudinal direction of the spinning frame.

6. A bobbin tranpsorting system as claimed in claim 1, further comprising a plurality of empty trays, transferring means for transferring said empty trays from the winder, a spinning bobbin supply device for supplying a spinning bobbin onto an empty tray transferred from the winder, and an empty bobbin supply device for supplying an empty bobbin transferred from the winder onto the transport band, wherein said spinning bobbin supply device and the empty bobbin supply device are provided at a spinning bobbin ejecting side of the spinning frame.

7. A bobbin transporting system as claimed in claim 6, wherein the spinning bobbin reservoir path, an empty bobbin reservoir path and an empty tray transporting path are arranged to extend in a longitudinal direction of the spinning frame.

8. A bobbin transport system for transporting empty bobbins and spinning bobbins between a spinning frame and an automatic winder, said transport system operable with a spinning frame having a plurality of spinning spindles on which a corresponding plurality of empty bobbins are supplied and from which a corresponding plurality of spinning bobbins are doffed, said transport system comprising:

a spinning bobbin transporting means for transporting spinning bobbins from the spinning frame to the automatic winder; and an empty bobbin transporting means for transporting empty bobbins from the winder to the spinning frame;

wherein the spinning frame includes a transport band movable in a first direction adjacent the spinning spindles of the spinning frame for transporting said plurality of spinning bobbins doffed from the spinning spindles to said spinning bobbin transporting means, said transport band being movable in a second direction adjacent the spinning spindles for transporting empty bobbins to be supplied to the spinning spindles from said empty bobbin transporting means; and wherein the spinning bobbin transporting means includes reservoir means for receiving said plurality of spinning bobbins doffed from the spinning frame and for simultaneously reserving all of said plurality of spinning bobbins.

9. A bobbin transport system as claimed in claim 8, wherein said reservoir means comprises a spinning bobbin reservoir path having a length sufficient for reserving thereon all of said plurality of spinning bobbins simultaneously.

10. A bobbin transport system as claimed in claim 9, wherein said spinning bobbin reservoir path is provided above the spinning frame and extends in the longitudinal direction of the spinning frame.

11. A bobbin transport system as claimed in claim 9, wherein said spinning bobbin reservoir path and said empty bobbin transporting means are provided above the spinning frame and extend in the longitudinal direction of the spinning frame.

12. A method for transporting empty bobbins and spinning bobbins between a spinning frame and an automatic winder, said method being operable with a spinning frame having a transport band movable in a first and second direction adjacent the spinning spindles of the spinning frame, said method comprising the steps of:

doffing a plurality of spinning bobbins from a corresponding plurality of the spinning spindles to the transport band;

transporting said plurality of doffed spinning bobbins with the transport band in the first direction to a spinning bobbin reservoir path;

reserving said plurality of doffed spinning bobbins in the spinning bobbin reserve path;

supplying a plurality of empty bobbins to the transport band; and transporting said plurality of empty bobbins with the transport band in the second direction to the spindles of the spinning frame, while simultaneously reserving a plurality of spinning bobbins in said spinning bobbin reservoir path.

* * * * *